US010825634B2

(12) United States Patent
Hansen et al.

(10) Patent No.: US 10,825,634 B2
(45) Date of Patent: Nov. 3, 2020

(54) X-RAY TUBE EMITTER

(71) Applicant: Varex Imaging Corporation, Salt Lake City, UT (US)

(72) Inventors: Wayne R. Hansen, Centerville, UT (US); Vance S. Robinson, South Jordan, UT (US); Kasey O. Greenland, West Jordan, UT (US); Gangqiang Wang, Salt Lake City, UT (US)

(73) Assignee: Varex Imaging Corporation, Salt Lake City, UT (US)

( * ) Notice: Subject to any disclaimer, the term of this patent is extended or adjusted under 35 U.S.C. 154(b) by 0 days.

(21) Appl. No.: 16/281,716

(22) Filed: Feb. 21, 2019

(65) Prior Publication Data

US 2020/0273656 A1 Aug. 27, 2020

(51) Int. Cl.

| | |
|---|---|
| ***H01J 35/06*** | (2006.01) |
| ***H01J 35/14*** | (2006.01) |
| ***H01J 35/18*** | (2006.01) |
| ***H01J 35/10*** | (2006.01) |

(52) U.S. Cl.

CPC ..... *H01J 35/06* (2013.01); *H01J 35/101* (2013.01); *H01J 35/14* (2013.01); *H01J 35/18* (2013.01)

(58) Field of Classification Search

CPC .. H01J 35/06; H01J 35/18; H01J 35/14; H01J 35/101

See application file for complete search history.

(56) References Cited

U.S. PATENT DOCUMENTS

2003/0053595 A1 3/2003 Taguchi et al.
2007/0183577 A1* 8/2007 Arnold ..... H01J 35/06 378/136
2009/0010393 A1* 1/2009 Klinkowstein ..... H05G 1/10 378/140
2009/0022277 A1* 1/2009 Bard ..... H01J 35/06 378/138
2009/0060142 A1* 3/2009 Adams ..... H01J 35/06 378/136
2010/0195798 A1 8/2010 Arnold et al.
2010/0284519 A1* 11/2010 Moore ..... H01J 1/20 378/136
2011/0142193 A1* 6/2011 Frontera ..... H01J 35/045 378/16
2014/0169523 A1 6/2014 Frontera et al.
2014/0254767 A1* 9/2014 Boye ..... H01J 35/14 378/136
2015/0063546 A1* 3/2015 Caiafa ..... H05G 1/50 378/113
2015/0092923 A1* 4/2015 Iida ..... G01N 23/046 378/138
2016/0093462 A1* 3/2016 Virshup ..... H01J 35/06 378/136
2016/0189908 A1* 6/2016 Lemaitre ..... H01J 35/06 378/136

(Continued)

*Primary Examiner* — Kiho Kim

(74) *Attorney, Agent, or Firm* — David Wilding

(57) ABSTRACT

An emitter for a closed x-ray tube includes an emitter body formed of a low work function emitter material, the emitter body having a major surface and a secondary surface. The major surface is adapted for emission of electrons from the low work function material. The emitter assembly is adapted to reduce an emission current density emitted from the secondary surface of the emitter body, as compared to the major surface.

25 Claims, 11 Drawing Sheets

(56) References Cited

U.S. PATENT DOCUMENTS

| | | | | |
|---|---|---|---|---|
| 2016/0217965 | A1* | 7/2016 | Canfield | H01J 35/045 |
| 2016/0358740 | A1* | 12/2016 | Hu | H01J 35/065 |
| 2017/0047207 | A1* | 2/2017 | Chuang | H01J 37/073 |
| 2017/0148605 | A1 | 5/2017 | Tesch et al. | |

* cited by examiner

FIG. 9A
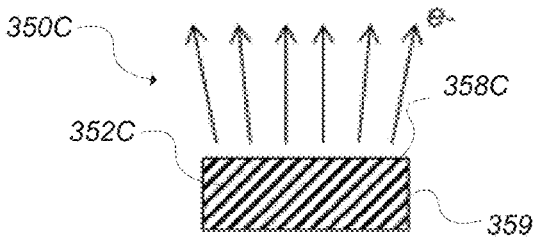
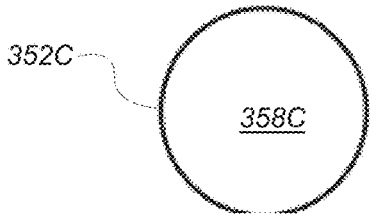
FIG. 9B
FIG. 10A
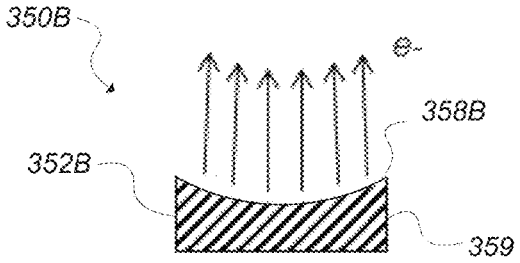
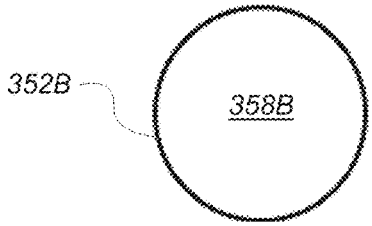
FIG. 10B
FIG. 11A
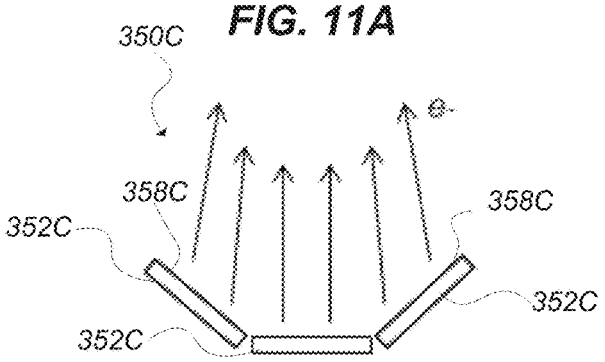
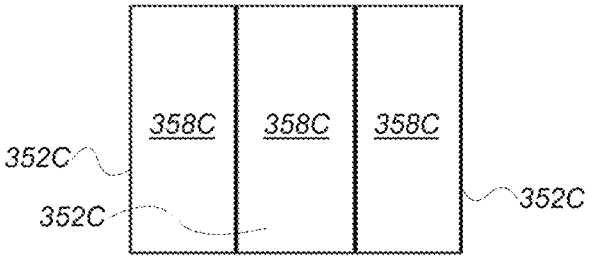
FIG. 11B

X-RAY TUBE EMITTER

BACKGROUND

X-rays are a form of high frequency, penetrating electromagnetic radiation, with energy and absorptive properties selected for use in a variety of different medical and industrial settings. Applications include, but are not limited to, medical imaging, diagnostics, radiology, radiotherapy, radiography and tomography, non-destructive testing, materials detection and analysis, and security and inspection.

Conventional x-ray tubes operate by emitting an electron beam from a source and directing the beam to impact a target, converting a portion of the electron energy into x-rays. The electron beam is commonly generated by heating a tungsten filament or another emitter to produce thermionic emission, or via field emission induced by a high-strength electric field at the emitter surface. The electrons accelerate from the emitter assembly (or cathode) toward the target (anode), gaining energy based on the potential difference across the anode-cathode separation or "throw distance" (throw length). Electric and/or magnetic fields can be used to control the shape of the electron beam cross section which defines the focal spot, the region on the target where the electron beam generates x-rays.

Characteristic x-rays are produced via x-ray fluorescence, which occurs when the incident electrons have sufficient energy to eject inner-shell electrons from atoms in the anode material. Outer-shell electrons drop down to fill the inner-shell vacancies, producing radiation at energies and frequencies characteristic of the material making up the anode. Bremsstrahlung (or "braking radiation") occurs when the incident electrons deflect in the target anode, producing a continuous spectrum of x-ray radiation terminating at a lower frequency corresponding to the applied voltage between the cathode and anode. The resultant x-ray spectrum is produced as a series of characteristic peaks corresponding to x-ray fluorescence from the anode material, superposed on the continuous Bremsstrahlung radiation.

BRIEF DESCRIPTION OF THE DRAWINGS

FIGS. 9A and 9B show sectional side and plan views illustrating electron emission from a flat-surface emitter body.

FIGS. 10A and 10B show sectional side and plan views illustrating electron emission from a non-planar emitter surface.

FIGS. 11A and 11B show sectional side and plan views illustrating electron emission from a plurality of angled flat-surface emitter bodies.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Numbers provided in flow charts and processes are provided for clarity in illustrating steps and operations and do not necessarily indicate a particular order or sequence. Unless otherwise defined, the term "or" can refer to a choice of alternatives (e.g., a disjunction operator, or an exclusive or) or a combination of the alternatives (e.g., a conjunction operator, and/or, a logical or, or a Boolean OR).

Some embodiments relate generally to x-ray systems and methods for generating x-rays, including x-ray tube and emitter designs. Other embodiments relate to low work function emitter materials adapted for improved thermionic emission and open cathode structures. Representative applications include, but are not limited to, imaging, diagnostics, radiology, radiotherapy, radiography and tomography, and a range of industrial x-ray technologies.

Conventional x-ray tube designs include tungsten coil-based emitters with operational current densities ranging up to approximately 1 to 4 amperes per centimeter squared (1-4 $A/cm^2$). The emitting area can be increased to obtain higher total emission at a given current density, but traditional helical-wound designs are subject to overall size limitations, typically in the range of about 0.025 inches (or 0.635 cm) coil outer diameter (OD). Electrons are emitted from the coil surfaces with varying angles, geometry, and localized electric field, and tungsten emitters operate at very high temperatures, typically up to 2100-2500° C., increasing the likelihood for movement and deformation.

A smaller, sharper focal spot can be easier to generate with a smaller emitting area and a more uniform emitter geometry. Thus, moving beyond traditional tungsten emitter technologies can present a number of opportunities for improved x-ray system design, including the use of advanced, lower work function emitter materials, with emitter designs adapted to generate sharper, microscale focal spots. For example, according to some embodiments of the present disclosure, emitters may be formed low work function (LWF) materials such that they operate at temperatures of below 1500° C., below 1200° C., or at 1000° C. or lower. Additionally, emitters may be configured to operate at work functions of 4.0 eV or lower, 3.0 eV or lower, or 2.5 eV or lower.

Figure 1:
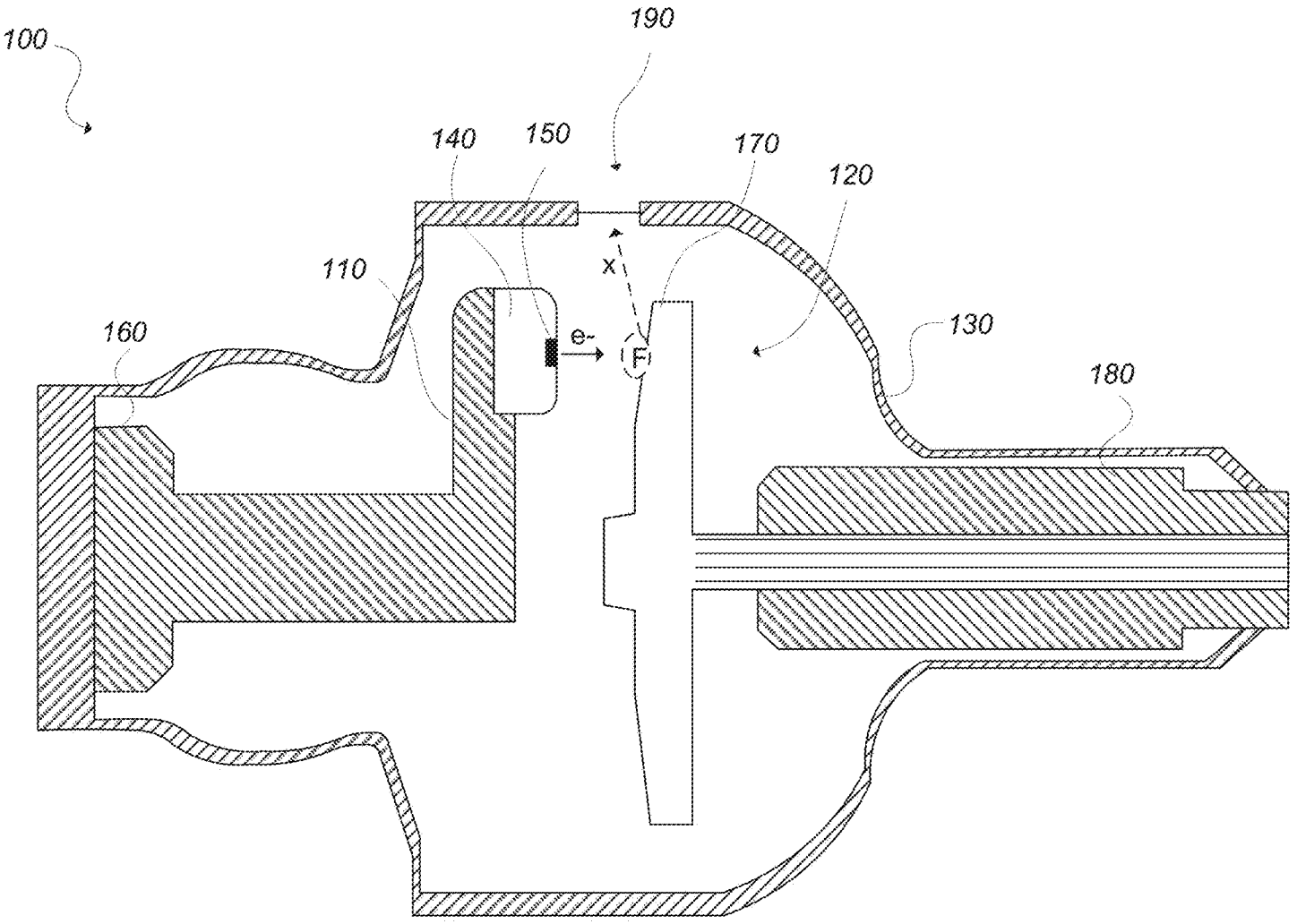
FIG. 1 is a sectional side view of an x-ray tube with a rotating anode and a low work function (LWF) emitter.

FIG. 1 is a schematic side section view of an x-ray tube system 100. The x-ray tube system 100 illustrated in FIG. 1 is a closed-tube embodiment, with the cathode (or cathode assembly) 110 and rotating anode 120 disposed in a sealed vacuum enclosure or insert 130. Alternatively, the x-ray tube system 100 can have an open configuration, using a pump to lower the nominal pressure and conditions the system 100 to a high vacuum level for operation. In some examples, the pumping system can shut down and the chamber can open, for example, to replace components.

The cathode assembly 110 includes a cathode head 140 with a LWF emitter 150. As used herein, the work function of a material is the minimum amount of energy, or thermodynamic work, needed to remove an electron from a solid to a point in a vacuum immediately adjacent to the solid surface. Melt temperature is often an indicator of chemical stability in vacuum. As described, and as measured on inhomogeneous surfaces, the work function is considered to be the lowest measurable work function on a surface of an emitter, as measured by field electron emission, photoemission, thermionic emission, or electron tunneling. Suitable materials for the emitter 150 include, but are not limited to, lanthanum boride and cerium boride materials, rhenium boride, cerium rhenium boride, and other suitable lanthanide crystal and rare earth metal boride materials. Low work function emitters 150 can also be formed of carbide materials such as hafnium carbide or zirconium carbide, oxide materials such as yttrium oxide (yttria), tungsten thorium (thoriated tungsten) or tungsten lanthanum (lanthanated tungsten) oxides, Schottkey emitters such as tungsten zirconium (zirconiated tungsten) oxides, and dispenser cathode materials such as a barium oxide compound in a porous tungsten matrix (see Table 1).

TABLE 1

Low Work Function (LWF) Emitter Materials

| Materials | Examples | Tags | T_melt (deg C.) | Work Function |
|---|---|---|---|---|
| Borides | Lanthanum Hexaboride | $LaB_6$ | 2210 | 2.7 |
| | Cerium Hexaboride | $CeB_6$, $CeB_{6\pm x}$ | 2552 | 2.5 |
| | Cerium Tetraboride | $CeB_4$ | | |
| Carbides | Hafnium Carbide | HfC | 3900 | 3.5 |
| | Zirconium Carbide | ZrC | 3532 | 3.3 |
| Oxides | Yttrium Oxide | $Y_2O_3$ | 2425 | 2.8 |
| | Tungsten-Thorium Oxide | W-Th-O | 3390 | 2.6 |
| | Tungsten-Lanthanum Oxide | W-La-O | 2080 | 3.0 |
| Schottkey Emitters | Tungsten-Zirconium Oxide (Zirconium Oxide/Tungsten) | ZrO/W | 2715 | 4.0 |

TABLE 1-continued

Low Work Function (LWF) Emitter Materials

| Materials | Examples | Tags | T_melt (deg C.) | Work Function |
|---|---|---|---|---|
| Dispenser Cathodes | Barium Oxide | BaSrCaO/W | 1150 | 2-2.4 |
| | Tungsten Matrix | $BaAl_2O_4$/W, etc. | 1150 | 2-2.4 |

Other transition metals may also be substituted for the tungsten components in Table 1, where the resultant emitter material maintains a lower work function than traditional tungsten electrodes, and operates in a lower temperature range or with a higher emission current density. Alternatively, traditional high work function (HWF) elements have also been used for some advanced emitter designs, for example tungsten (W), Niobium (Nb) or Tantalum (Ta), and other suitable transition metal-based emitter materials.

When the x-ray tube system 100 is assembled, the cathode 110 extends from a high-voltage standoff 160 disposed on one end of the insert 130, positioning the cathode head 140 and LWF emitter 150 with respect to the anode 120. The anode (or anode assembly) 120 can include a rotating target 170, which is supported on a bearing or rotor 180, which may extend to the opposite end of the insert 130. Alternatively, as detailed below, the anode 120 can be a stationary element in an x-ray tube system 100.

In operation of the x-ray tube system 100, electrons are emitted from the emitter 150, which is seated in the cathode head 140 with the major emitter surface oriented toward the anode 120. A high voltage potential difference is applied between the emitter 150 and the anode 120, forming an electron beam (e−) directed from the emitter 150 and impinging onto a focal spot (F) defined on the target 170.

Some fraction of the impinging electron energy converts to high energy radiation in the form of x-rays (x), which emerge from a window structure 190 on the side of the insert 130. The emerging x-rays can be directed, for example, toward the body of a patient for medical imaging, diagnostics or radiotherapy, or toward some object of interest for use in non-destructive testing, materials detection and analysis, or security inspection.

Depending on x-ray tube design, the potential difference between cathode head 140 and the anode target 170 can range from 10-100 kilovolts (kV) up to 450 kV, or more. Typical beam currents also vary, but may be on the order of milliamperes (mA) to 1-2 ampere (1-2 A), or more. The spot size may be reduced or minimized as much as possible to provide sufficient image quality without compromising the target material. As a result, the thermal loading on the anode 120 can be substantial, and while the target 170 can rotate to distribute the heat more evenly, both the cathode assembly 110 and the anode 120 are carefully designed to provide reliable operation over the expected service life of the x-ray tube. At the same time, use of a low work function emitter 150 can also provide improved current density and focal spot control, for enhanced high-intensity x-ray production.

In closed tube applications (e.g., utilizing a sealed vacuum enclosure 130), the emitter 150 and other components can also be adapted to reduce outgassing and other effects during operation of the x-ray tube system 100, providing improved service life with reduced risk of tube failure. Other x-ray tube systems can use getters or actively pumped configurations that use a continuously running vacuum pump system to remove excess gas and maintain a high quality vacuum environment.

Figure 2:
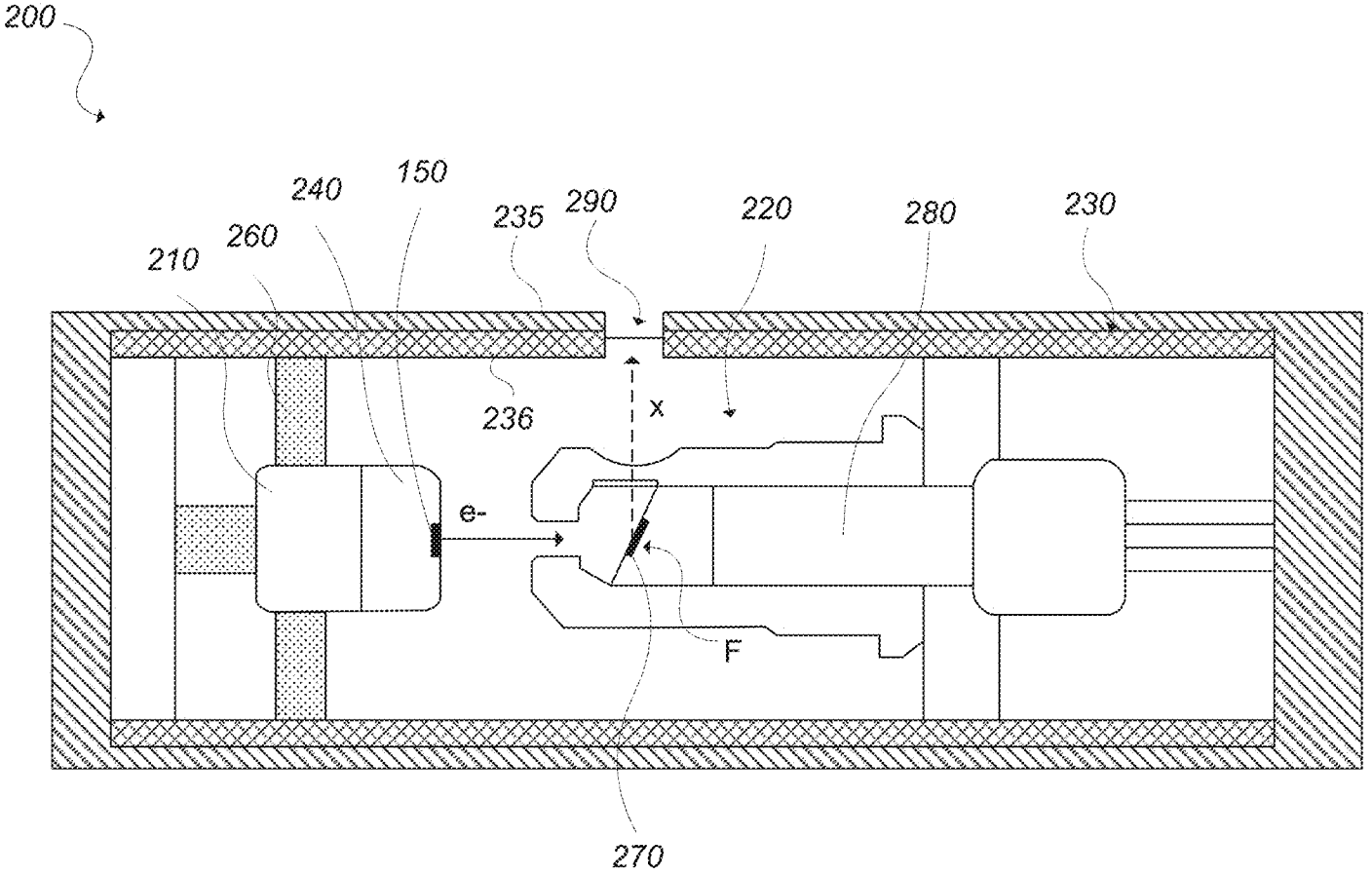
FIG. 2 is a partial sectional side view of an x-ray tube with a stationary anode and a LWF emitter.

FIG. 2 is a side section view of an x-ray tube system 200, in a closed-tube configuration with a cathode assembly 210 and a stationary anode 220 disposed in a sealed vacuum enclosure or insert 230. The cathode assembly 210 extends from a high voltage standoff 260, which is disposed on one end of the insert 230, to support a cathode head 240 with a LWF emitter 150.

In this particular embodiment, the anode 220 includes a stationary target 270. A cooling system 280 is provided to dissipate heat generated by the impingement of the electron beam (e−) onto the fixed anode target 270, generating high frequency radiation in the form of x-rays (x) that exit the x-ray tube 200 from the window 290 in the side of the insert 230. In some embodiments a housing 235 surrounds the inner vacuum enclosure 236, where housing 235 can define the size, shape, and position of window 290.

Emitter materials with a relatively low work function can be used to improve thermionic emission and electron beam current density, or both, without increasing the emitter area or operating temperature. Suitable lanthanide and rare earth metal boride materials may have work functions in the range of about 2.5 to 2.8 electron volts (2.5-2.8 eV), or less than about 3.5 eV for yttria and some carbide materials, which is still substantially lower than traditional high-temperature metal-based emitters like tungsten, which has a work function of about 4.5 eV. These materials can also provide a relatively higher emission constant, or both a lower work function and a higher emission constant.

Figure 3:
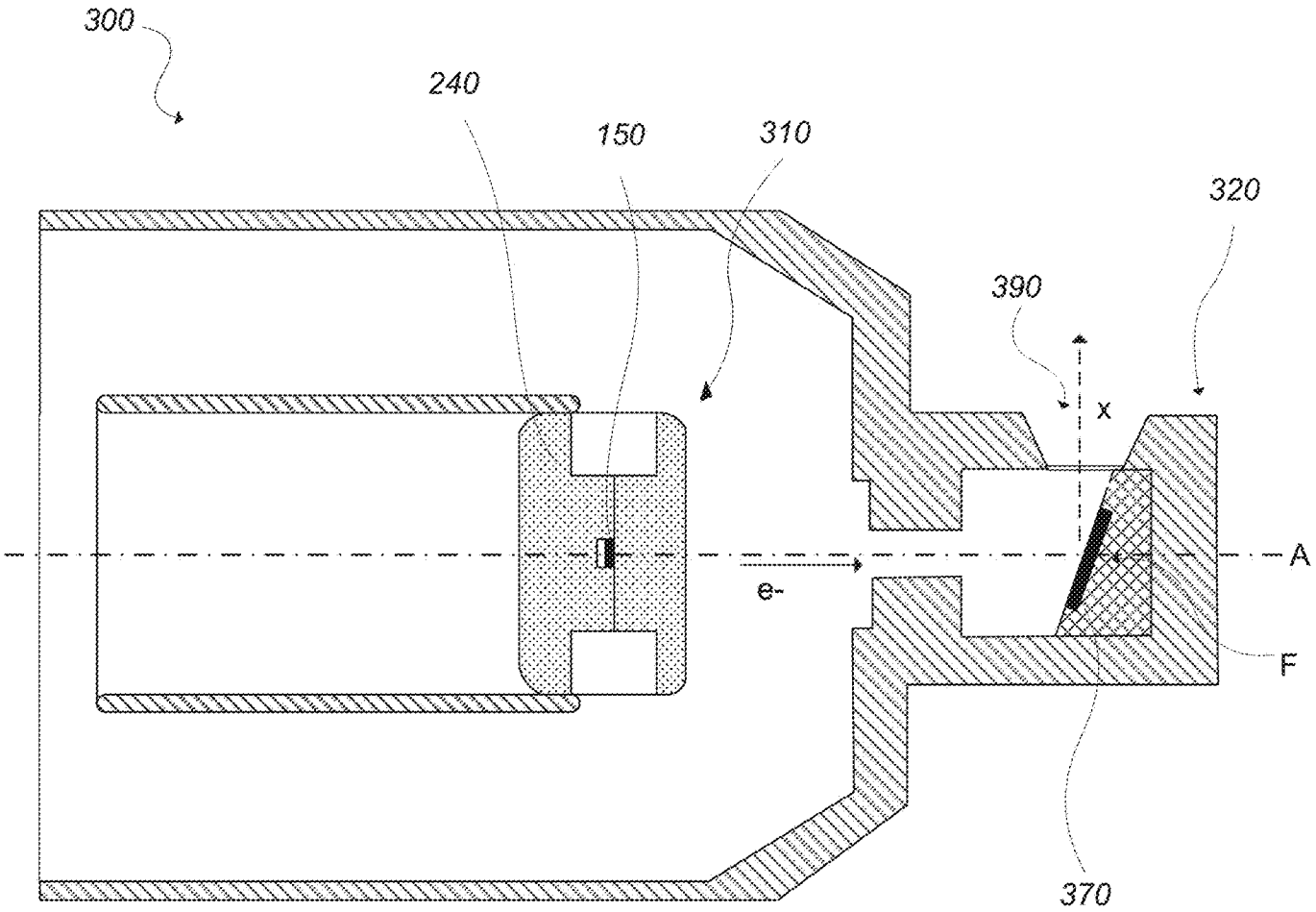
FIG. 3 is a sectional side view of an anode and cathode assembly for an x-ray tube, with LWF emitter.

FIG. 3 is a detail view of an x-ray tube assembly 300 for a fixed-target (stationary anode) x-ray tube apparatus, with a LWF emitter 150. As shown in FIG. 3, a cathode assembly 310 includes a cathode head 240 with a coaxially oriented LWF emitter 150, disposed along the longitudinal x-ray tube axis A. An anode 320 has a fixed target 370, also disposed along axis A.

The emitter 150 utilizes low work function materials exhibiting a geometry adapted for use in closed or sealed x-ray tube applications, including reflection targets in rotating anode or stationary anode x-ray tubes, and transmission anodes. In the particular example of FIG. 3, the emitter 150 is formed as a cylinder with outer diameter (OD) and a flat, circular emitting surface. Alternatively, the emitter 150 can have a truncated cone, top hat, horizontal cylinder, or rectangular solid shape, or an asymmetric or irregular geometry, including, but not limited to, the representative examples in any of FIGS. 5A-5D, 6A-6B, 7A-7B, 9A-9B, 10A-10B, 11A-11B, 12, and 13A-13C.

Direct or indirect heating can be used to operate the emitter in a thermionic emission temperature range, for example approximately 1000° C. to 1200° C., depending on the emitter material and desired current density. These operating temperatures are substantially lower than temperatures typically used for traditional tungsten filament emitters, which typically operate at well over 2000° C. The current density can also be up to an order of magnitude higher, so a relatively small LWF emitter may be able to provide the same tube current as a much larger tungsten filament, with a substantially smaller nominal focal spot size. These advantages can also be adapted for use in a micro-focus x-ray tube.

Low work function materials provide greater electron flux, for a given emitter area, enabling improvements in high current applications like computed tomography (CT), for example, with an emission current of 1.5 A or more, and a 70 kV or higher cathode-anode potential difference. Suitable low work function materials can also be ground and/or formed into different shapes such as rectangular solids, cylinders, and truncated cones, etc., allowing emission electrons to be generated with more laminar trajectories than with traditional helical wound filaments.

Low work function emitter materials are more amenable to masking and other means of minimizing edge effects that are common in both coiled filaments and flat emitter geometries because they operate at lower temperatures. Selected lanthanide crystal and rare earth metal boride materials can also be less susceptible to poisoning than traditional dispenser cathode materials; and particular materials such as cerium hexaboride ($CeB_6$) may be less susceptible than other materials such as lanthanum hexaboride ($LaB_6$), for operating temperatures up to about 1650° C. or 1750° C.

Figure 4A:
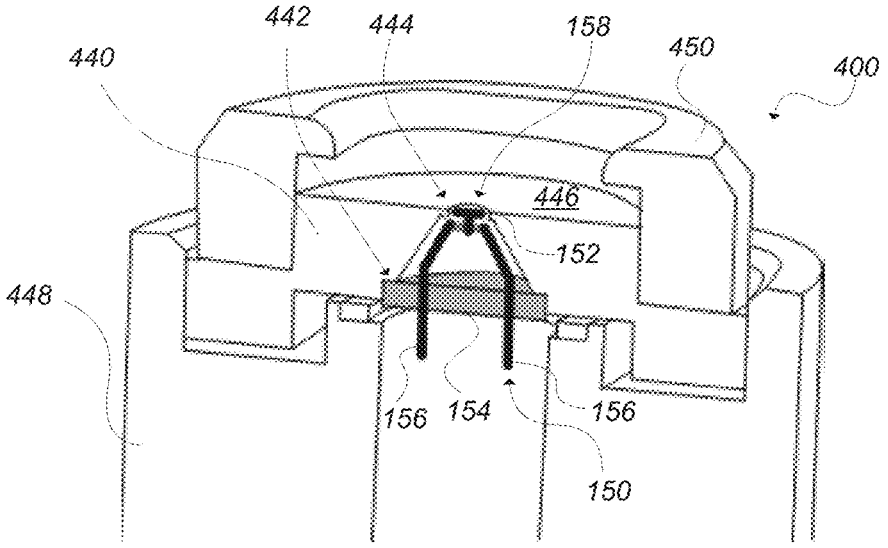
FIG. 4A is an isometric section view of a cathode assembly with a LWF emitter.

FIG. 4A is an isometric section view of a cathode assembly 400 for an x-ray tube, with a LWF emitter 150 disposed in the cathode head 440. The emitter 150 includes an emitter body 152 formed of a low work function emitter material, coupled to a ceramic disk or base 154 via one or more supports 156. The ceramic disk or base 154 provides electrical insulation.

The base 154 of the emitter 150 engages within a seat 442 defined in the bottom of the cathode head 440, positioning the emitter body 152 within an aperture 444, in the anode-facing surface 446 of the cathode head 440. The major surface 158 of the emitter body 152 is adapted for emitting electrons, for example, via thermionic emission, in response to joule heating.

A base or similar cathode support structure 448 couples to and supports the cathode head 440 inside the x-ray tube, and the cathode head is adapted for positioning and maintaining alignment of the emitter 150 with respect to the anode, within the vacuum enclosure. A focusing cup or field guide 450 can be disposed about the anode-facing (top) surface 446 of the cathode head 440, in order to further shape the electric field and help focus the electrons into a beam directed to a well-defined focal spot on the anode target. The cathode head 440 and the field guide 450 can both provide focusing structures. Additionally, the cathode head 440 and the field guide 450 can provide high voltage shielding to the cathode head 400.

Suitable assemblies 400 can include a LWF emitter 150 disposed in the cathode head 440. The emitter includes an emitter body 152 coupled to a base 154 by one or more supports 156, with a major surface 158 adapted for the emission of electrons. The emitter body can be formed of a low work function material such as cerium hexaboride, or another suitable lanthanide crystalline material or rare earth metal oxide. Other suitable materials are described in Table 1.

Figure 4B:
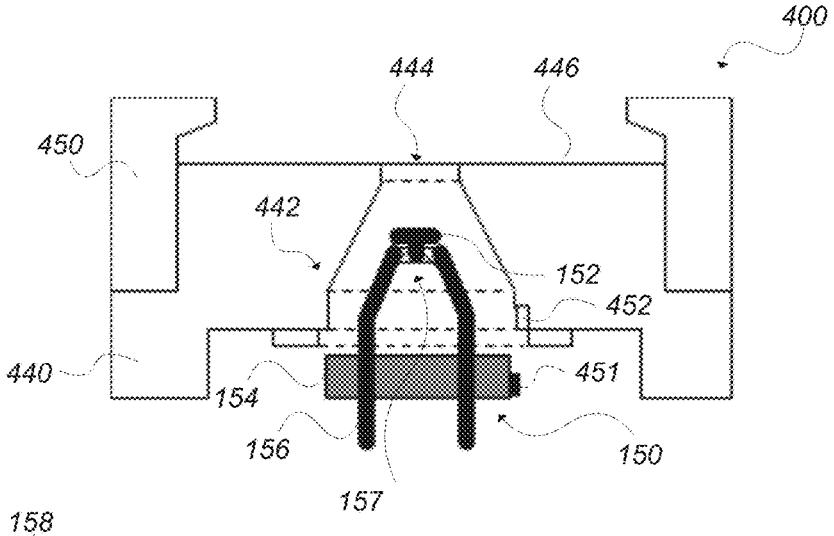
FIG. 4B is a side section view of a LWF emitter and a cathode head prior to seating of the emitter.

FIG. 4B is a side section view of the cathode assembly 400 and LWF emitter. As shown in FIG. 4B, the emitter base 154 and the seat 442 can be provided with complementary alignment features 451, 452, for example using a self-alignment key and slot or a similar pin and hole arrangement, in order to rotationally orient the emitter body 152 within the aperture 444 in the cathode head 440. Alternatively, the emitter base 154 and the seat 442 can be keyed using a complementary (and rotationally asymmetric) circumferential geometry, or alignment features 451, 452 may be absent (for example, where either or both of the emitter body 152 and major emitter surface 158 are rotationally symmetric with respect to the cathode head 440).

Figure 4C:
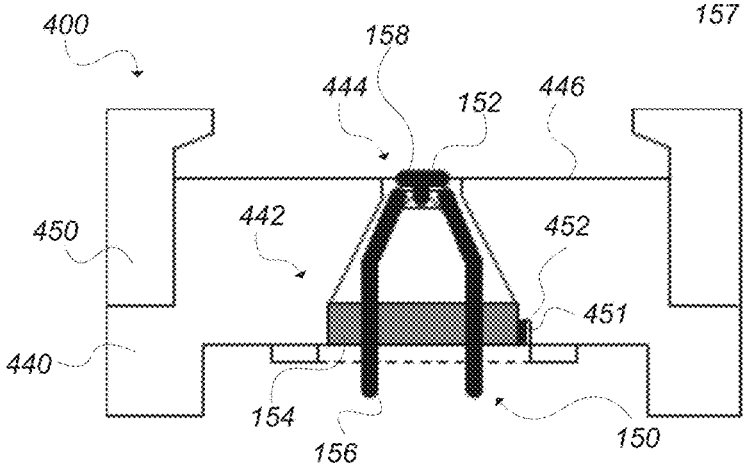
FIG. 4C is a side section view showing the emitter seated in the cathode head.

FIG. 4C is a side section view showing a LWF emitter 150 seated in a cathode head 440. As shown in FIG. 4C, seat 442 is adapted to engage the emitter base 154 so that the emitter body 152 is centered within the aperture 444, with the emitter body 152 spaced a desired distance from the anode-facing cathode head surface 446 along the entire circumference of the major (top) emitter surface 158.

The emitter 150 can thus be quickly and easily seated into the cathode head 440, with the emitter body 152 correctly positioned within the aperture 444 on the anode-facing surface 446, and spaced from cathode head 440 along the outer perimeter of the major emitter surface 158. Suitable spacing clearance varies, for example, from about one mil (0.001 inch, or about 25 microns) to about eight or ten mil (0.008-0.010 inch, or 200 to 250 microns), or more. In another example, the spacing between the inner perimeter of the aperture 444 of the cathode head 440 and the outer perimeter of the major emitter surface 158 is less than 0.5 millimeters (mm).

The engagement between the ceramic base 154 and the seat 442 is also configured to prevent contact between the emitter body 152 and the inner surface of the cathode assembly, both during and after assembly, ensuring correct placement of the major emitter surface 158 within the aperture 444 in the cathode head 440. The surface 158 of the emitter body 152 can also be angularly oriented with respect to the cathode head 440, and disposed proud of, flush with, or recessed from the anode-facing surface 446. This self-aligning cathode arrangement can substantially reduce time and resources that would be required to manually position and orient the emitter 150 within a cathode, while preventing contact with the emitter body 152 to reduce the risk of incidental damage, contamination, or misalignment.

In the particular examples of FIGS. 4A, 4B and 4C, the emitter body 152 has a "top hat" or a generally T-shaped configuration, with a major emitter surface 158 defined in the top portion, and the bottom portion being disposed between first and second supports 156, opposite the major (top) surface 158. In some embodiments, the supports 156 are formed of conductive material, and adapted to carry current for direct joule heating of emitter body 152. One or more wires or conducting filaments 157 can also be provided in order to conduct current across the supports 156; e.g., as shown in FIG. 4B.

In closed x-ray tube embodiments, the emitter 150 is disposed inside the cathode head 440, with the emitter body 152 extending into aperture 444 in the anode-facing surface 446. The emitter body 152 is coupled to a ceramic base 154 via one or more supports 156, with the major surface 158 positioned to generate an electron beam. The electrons are directed toward an anode, which emits x-rays responsive to impingement of the electron beam.

As shown in FIGS. 4A-4C, the major emitter surface 158 is planar and the emitter body 152 is rotationally symmetric about a perpendicular axis P extending through the emitter body 152 and the cathode head 440. The cathode head 440 can be coaxially arranged in a vacuum enclosure to simplify the tube geometry, allowing the focal spot to be centered in the tube (see FIG. 3). Emitters that are displaced from the tube centerline typically require an offset mounting structure and other non-orthogonal elements to center the focal spot on the target. These offset structures can increase the number of machining setup and assembly acts, while coaxial geometries can reduce manufacturing costs and turnaround times.

The emitter 150 can be aligned (with or without alignment features 451, 452) by engaging the base 154 within a complementary seat 442 in the bottom of the cathode head 440, so that the emitter body 152 is aligned in a coaxial arrangement with the cathode head 440, rotationally symmetric about the common axis P. In fixed target applications, the emitter 150 and the cathode head 440 can also be coaxially arranged along the x-ray tube axis, within the vacuum enclosure.

Figure 12:
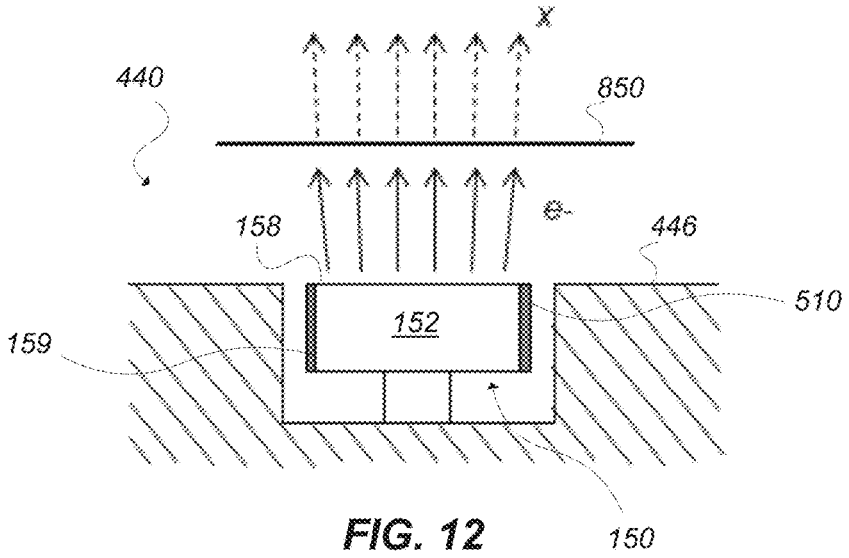
FIG. 12 is a schematic section view of a shielded LWF emitter with a transmission anode target.

In one such configuration, the major surface 158 of the emitter body 152 is rotationally symmetric about the common axis of the emitter body and the x-ray tube, as shown in FIG. 2. The emitter 150 can also be used in various embodiments including, for example, with a rotating anode x-ray tube, as shown in FIG. 1, or with a transmission target, as shown in FIG. 12.

As shown in any of FIG. 5A-5D, 6A-6B, or 7A-7B, the cathode assembly 400 can be adapted to reduce the emission current density from the lateral side surfaces 2 of the emitter body embodiments as compared to the major (anode-facing) emitter surface 158. A second emitter element can be disposed adjacent any of the emitter body embodiments along the anode-facing surface 446 of the cathode head, for example a tungsten filament or other transition metal emitter, as shown in FIG. 8.

Figure 5A:
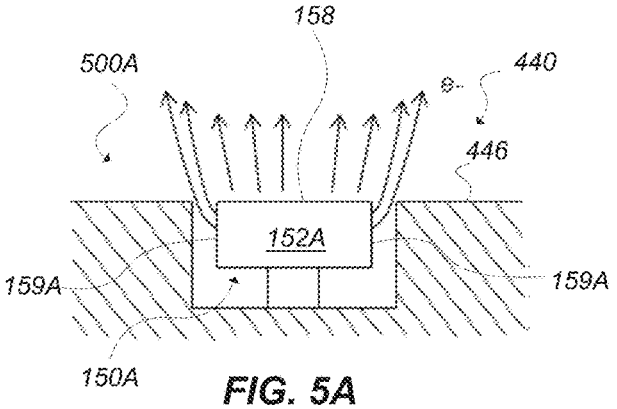
FIG. 5A is a side section view of an emitter assembly, illustrating electron emission from major and lateral surfaces of a LWF emitter body.

FIG. 5A is a side section view of an emitter assembly 500A, illustrating electron emission from the major surface 158A of a LWF emitter body 152A, and from the secondary (side) surfaces 159A. With emitter 150A having a solid emitter body 152A, as shown in FIG. 5A, electrons (e−) are emitted not only from the major (top, anode-facing) emitter surface 158A, but also from the side surfaces 159A, extending laterally from major surface 158A, along the sides of the emitter body 152A.

These "side emission" electrons can also be pulled toward the anode, along with the electrons emitted from the major surface 158. Electrons coming off the lateral sides 159A, however, will also be deflected by the metallic cathode head 440 or other structures, and approach the anode "off focus," away from the primary desired focal spot.

Figure 5B:
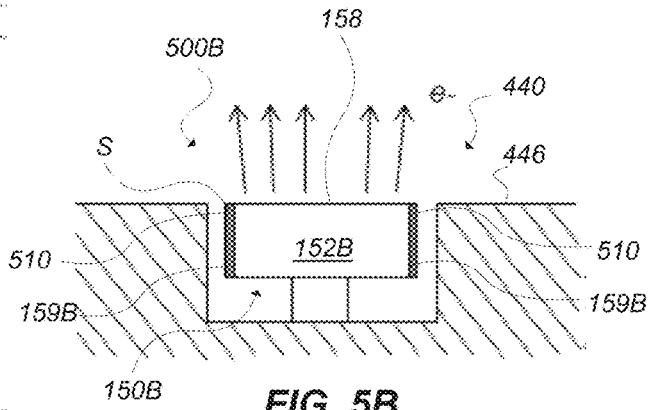
FIG. 5B is a side section view of an emitter assembly, illustrating electron emission from a LWF emitter body with an emission shield.

FIG. 5B is a side section view of the emitter assembly 500B, illustrating reduced side emission from an emitter 150B having an emitter body 152B with an emission shield 510. The shield 510 can include a coating or layer. For example, the shield 510 can include a carbon, graphite, tungsten, rhenium, or platinum coating, or another suitable material that is either disposed on or coupled to one or more side surfaces 159B of the emitter body 152B. The shield 510 prevents or reduces emission from the side surfaces 159B, producing a sharper and more uniform focal spot.

With shield 510 disposed on the sides of the emitter body 152B, electron emission is suppressed from the secondary surfaces 159B, and the electron beam is generated primarily from the major emitter surface 158B. This provides more parallel and uniform trajectories for the electrons, as they travel from the emitter body 152B toward the anode.

In one example, the shield 510 is made with a material having a higher work function than the adjacent surfaces 159B of the emitter body 152B, in order to further reduce or substantially eliminate electron emission from the side surfaces 159B, as compared to the major surface 158B.

In some embodiments, the shield comprises carbon, graphite, tungsten, rhenium, or platinum. These and other shield materials can also be selected for inertness to chemical reactions with the low work function material of the emitter body 152B. That is, the material of shield 510 can be selected to reduce or substantially eliminate chemical reactions with the emitter material, and to substantially avoid altering the composition, structure, or emission properties of the emitter 150B. The shield material can be also selected for stability in a vacuum at operating temperatures of up to about 1500° C., or more, and can be applied in a thickness of one millimeter (1 mm), or more or less, so that the shield 510 reduces side emission without adding significant thermal mass to the emitter 150B.

In various embodiments, the shield 510 can be disposed directly on the emitter body 152B, to remain in close and direct contact with the side surfaces 159B, extending laterally from the major surface 158B. Alternatively, a gap, insulator, physical interface between two materials, or similar thermal decoupling can be provided between the shield 510 and the sides surfaces, and the outward-facing surface S of the mask 510 can operate at a lower temperature than the secondary surface 159B. In these applications, the shield may be formed of the same low work function material used for the emitter body 152B, but can still operate to reduce the emission current density, since the outer surface S is maintained at a lower temperature than the side surface 159B of the emitter.

Figure 5C:
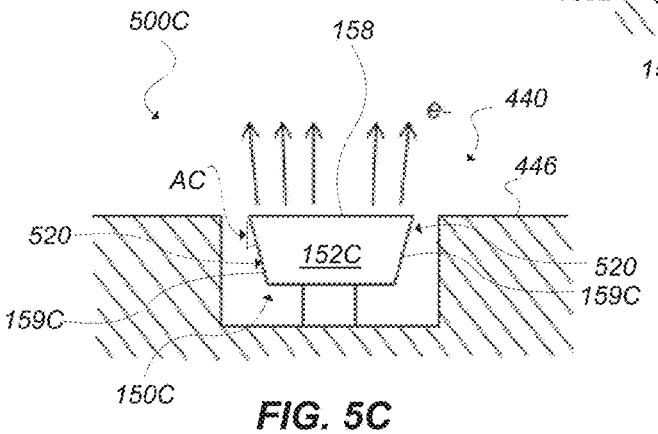
FIG. 5C is a side section view of an emitter assembly, illustrating electron emission from a tapered LWF emitter body.

FIG. 5C is a side section view of the emitter assembly 500C, illustrating electron emission from an emitter 150C having an emitter body 152C with a taper or undercut 520. The taper or undercut is defined on one more lateral side surfaces 159C. The undercut, tapered geometry reduces emission from side surfaces 159C due to a decrease in local field strength, based on the angle formed between the side surface 159C and the major emitter surface 158C, and the extended length of the undercut surface.

In some embodiments, the taper or undercut 520 on the side surfaces 159C extends at an acute angle AC from the major surface 158C, as shown in FIG. 5C. Typically, the acute angle is between 0 and 90 degrees. In other examples, the acute angle is between 5 and 75 degrees, between 10 and 80 degrees, between 20 and 70 degrees, between 30 and 60 degrees, or between 40 and 50 degrees.

Figure 5D:
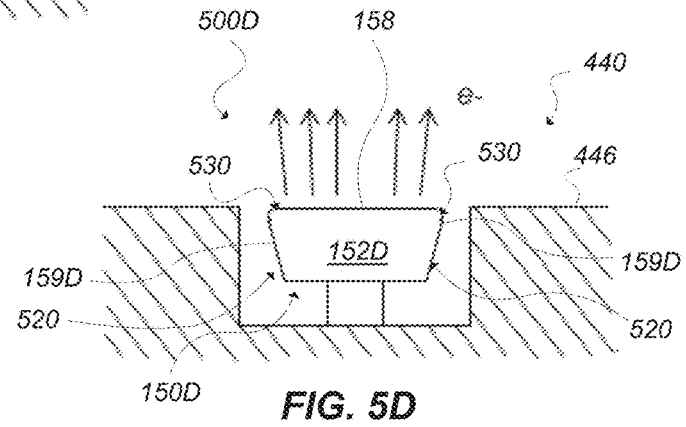
FIG. 5D is a side section view of an emitter assembly, illustrating electron emission from an tapered LWF emitter body with beveled edges.

FIG. 5D is a side section view of the emitter assembly 500D, illustrating electron emission from an emitter 150D having an undercut emitter body 152D with tapered or beveled edges. As shown in FIG. 5D, the side surfaces 159D of the emitter body 152D are provided with a taper or undercut 520 that extends laterally from the major surface 158, at an acute angle AC. Alternatively, the side surfaces 159D may extend at an acute, perpendicular, or obtuse angle AC.

A bevel 530 is defined between the major surface 158D of the emitter body 152D, and the side surfaces 159D. The bevel can be rounded, chamfered, or otherwise shaped to reduce the sharpness of the emitter body, as compared to the sharpness of the angle AC. Reducing the sharpness of corners on the emitter body decreases the local field strength, reducing the emission current density along the corner interface between the major surface 158D and the adjacent lateral side surfaces 159D.

In other examples, the taper or undercut 520 of FIG. 5C or the bevel 530 of FIG. 5D may include a shield 510 as described in relationship to FIG. 5B.

Figure 6A:
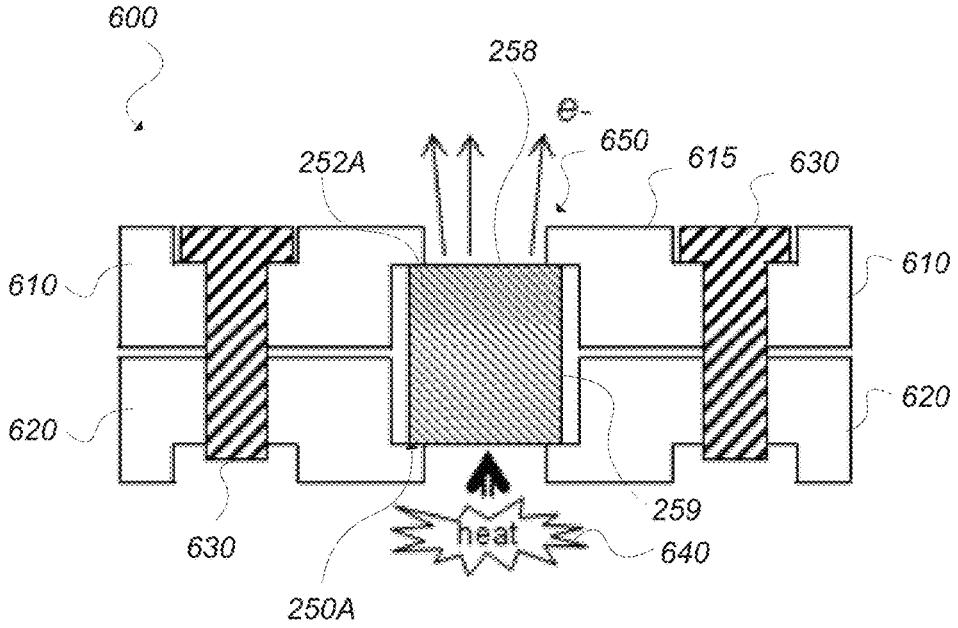
FIG. 6A is a side section view of a LWF emitter with a mask fixture according to an embodiment.
Figure 6B:
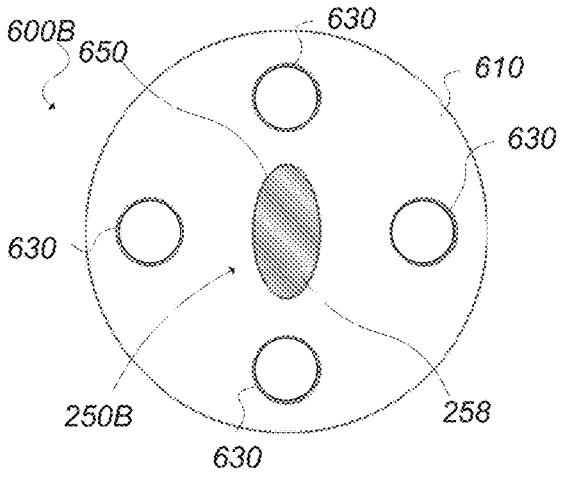
FIGS. 6B and 6C are exemplary plan views of the emitter and fixture shown in FIG. 6A.
Figure 6C:
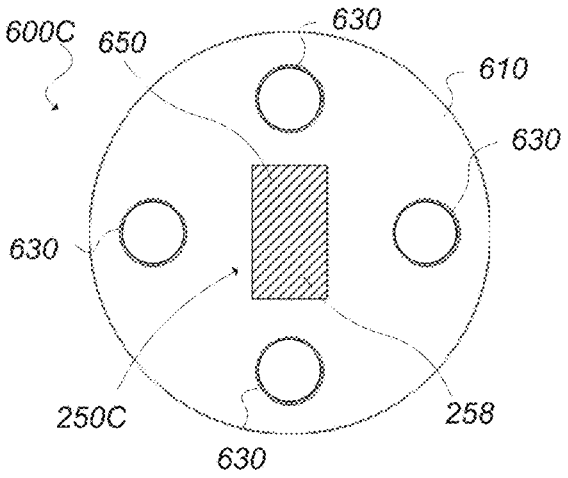

FIG. 6A is a side cross sectional schematic view of a LWF emitter 250A with an exemplary mask fixture 600. FIGS. 6B and 6C are plan views of the emitter 250A and fixture 600 of FIG. 6A with various opening geometries for emitters 250B and 250C, including an oval in fixture 600B and a rectangle in fixture 600C, respectively.

As shown in FIGS. 6A-6C, fixture 600, 600B, 600C includes a first (top) clamp fixture member 610 and a second (bottom) clamp fixture member 620, disposed on opposing sides of the emitter body 252A. The clamp fixture members 610, 620 can be any material that does not emit electrons (i.e. has a higher work function than the emitter material or a lower melting temperature than the emitter), and will be inert relative to the emitter material across the temperature range experienced by the emitter in production an operation. In one embodiment, the rate of chemical reaction or the extent the clamp fixture members 610, 620 react with and penetrate the emitter material is minimized so that it does not significantly impact the emitter performance over the life of the x-ray tube. Examples of suitable materials include, but are in no way limited to, graphite, rhenium, tungsten, molybdenum, and similar materials.

Mechanical connectors 630 such as screws or bolts couple the top and bottom fixture members together about the emitter body 252A, defining a masked emission area or window 650 for the major emitter surface 258, and inducing a compression force to fix the emitter body 252A in place between the first and second fixture members 610 and 620. As illustrated in FIG. 6A, the major emitter surface 258 can be engaged by an undercut portion of the first fixture member 610. Consequently, the first fixture member 610 can impart a compressive force directly on a portion of the major emitter surface 258. According to this configuration, the major emitter surface 258 is recessed from a top surface 615 of the first fixture member 610.

Figure 7A:
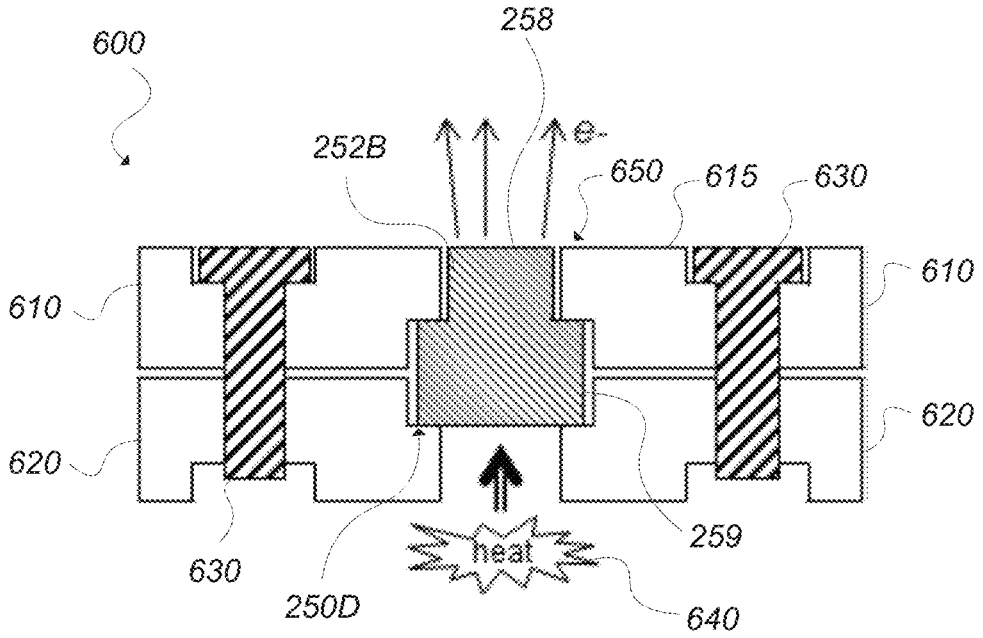
FIG. 7A is a side section view of a LWF emitter with a fixture according to another embodiment.
Figure 7B:
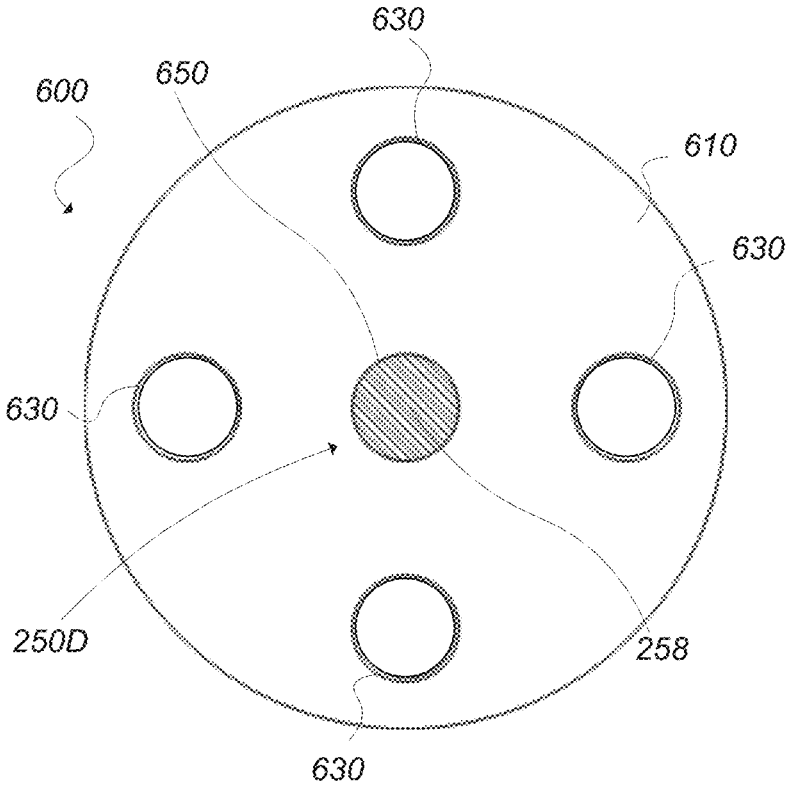
FIG. 7B is a plan view of the emitter and fixture shown in FIG. 7A.
Figure 8:
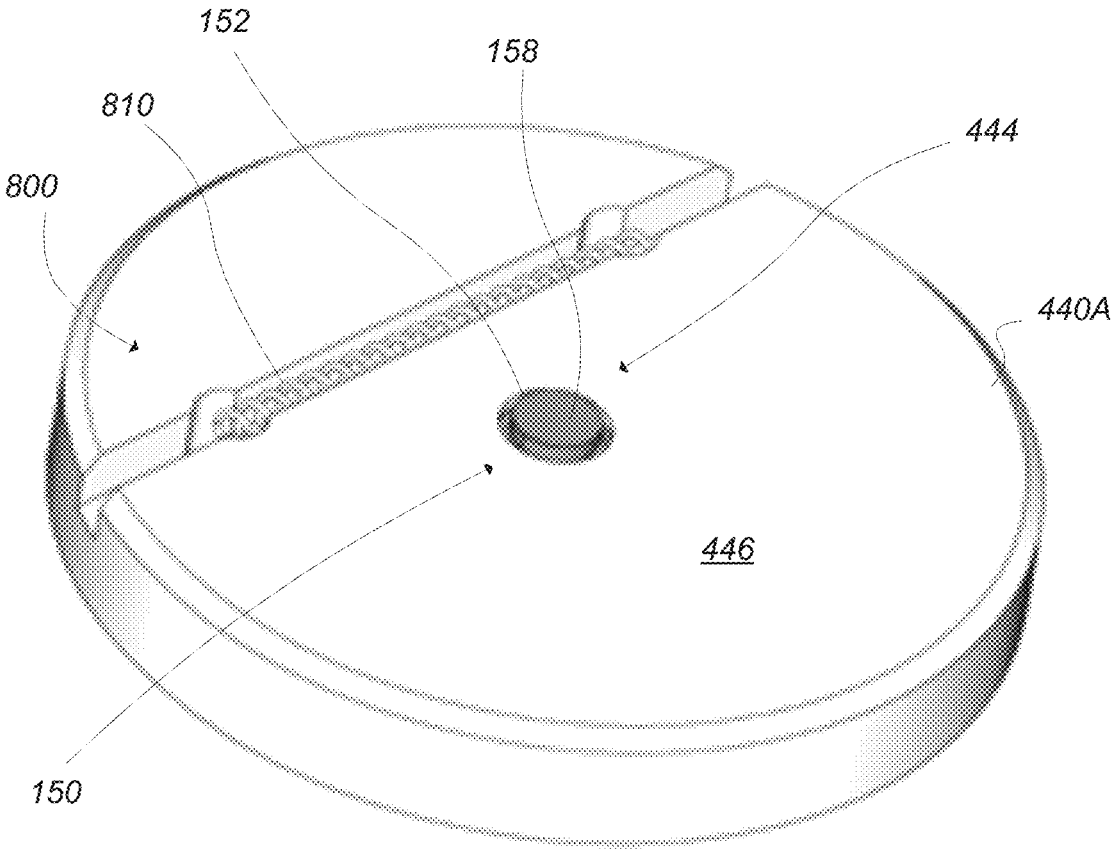
FIG. 8 is an isometric view of a cathode head with a LWF emitter and coil filament.

FIG. 7A is a schematic section view of a LWF emitter 250D with an alternate mask fixture 600 disposed about emitter body 252B. FIG. 7B is a plan view of the emitter 250D and fixture 600 shown in FIG. 7A. As illustrated, the mask fixture 600 of the LWF emitter 250D defines a circular emission area or window 650, in contrast to the oval or elliptical emission area or window shown in FIG. 6B and the rectangular emission area or window shown in FIG. 6C.

FIGS. 6A-6B and 7A-7B illustrate different options for providing rigidity and mechanical stability to fix the emitter body 252A, 252B in place with respect to the cathode head. Indirect heating 640 is used to achieve the desired operating temperature for emission of electrons from major surface 258 of the emitter body 252A, 252B, for example, joule heating, radiative or conductive transfer, or a combination thereof.

In some embodiments, the emitter assembly 500 includes a mask and/or shield fixture 600 disposed about the perimeter of the emitter body 252A, 252B; e.g., where the secondary or side surface 259 extends from the major surface 258 along a side of the emitter body 252A, 252B. The fixture 600 can be configured to modulate the electric field strength along the secondary surface 259 of the emitter body 252A, 252B, in order to reduce the emission current density along the side.

The fixture 600 can also be disposed about a perimeter of the major surface 258 of the emitter body 252A, 252B, shielding at least a portion of the major surface 258. In these embodiments, the aperture or window 650 defines an emission area that is smaller than the major surface 258. The fixture 600 can also be spaced about the circumference of the emitter body 252A, 252B, in order to reduce the current density along the side surfaces 259, as compared to the emission window 650 defined on the major surface 258. As illustrated in FIG. 7A, disposing the fixture 600 about a recessed perimeter 259 of the major surface 258 allows the emitter face or the exposed portion of the major surface 258 to be selectively positioned relative to the top surface 615 of the first fixture member 610. As shown in FIG. 7A, the recessed perimeter 259 of the major surface 258 is sized to position the emitter face or the exposed portion of the major surface 258 to be substantially flush with the top surface 615 of the first fixture member 610.

FIG. 8 is an isometric view of a cathode head 440A with a LWF emitter 150 and a second high work function (HWF) emitter 800 (e.g., a tungsten filament or coil element 810, or a similar high temperature, high work function transition metal filament). The cathode head 440A can use any of the features as described in relation to FIGS. 4A-7B. Using a tungsten filament 810 (or other high work function emitter) in conjunction with the LWF emitter 150 provides for additional processing acts, such as measuring the internal vacuum pressure of the x-ray tube, which may be calibrated for a traditional metal filament 810.

As shown in FIG. 8, the LWF emitter 150 is disposed approximately in the middle of cathode head 440, with the major surface 158 of the LWF emitter 150 being adapted for emission of electrons from within the central aperture 444. The HWF emitter 800 is spaced from the LWF emitter 150 along the anode-facing surface 446, which can be situated to one side of the cathode head 440. The LWF emitter 150 has a lower work function than the HWF emitter 800, typically in the range of about 3.5 eV or below. The HWF emitter 800 has a relatively higher work function, for example in the range of 4.0 eV and above.

The HWF emitter 800 provides for generating a second, more traditionally defined focal spot on the anode target. The emitters 150 and 800 can be wired for operation as a dual focus x-ray generator, with a relatively larger-focus x-ray source based on the HWF emitter 800, with a traditional tungsten filament 810, and a smaller micro-focus x-ray source using the LWF emitter 150, with a low work function emitter body 152. Both emitters can be provided together in the same cathode head 440, for use in the same x-ray tube.

FIGS. 9A and 9B provide a side sectional view and a plan view illustrating electron emission from an emitter 350A having an emitter body 352A with a flat major surface 358A and side surfaces 359. Since the focal spot size varies with emitter area, the minimum focal spot size achievable with given planar emitter surface may or may not produce sufficient beam current depending on the intended application. In some applications, the planar emitter surface area may not able to produce a small enough focal spot for desired imaging application, due to insufficient compression of the electrons in the electron beam direction, oriented toward the target anode (arrows). To address these concerns, other emitter geometries can be employed.

FIGS. 10A and 10B provide a side sectional view and a plan view illustrating electron emission from an emitter body 352B with a non-planar major surface 358B and side surfaces 359, for example on a LWF emitter 350B for an x-ray tube. As shown in FIG. 10, the emitter body 352B has a dished or bowl shape, with a concave major surface 358B providing a self-lensing effect for focusing the emitted electrons to a tighter, denser, narrower beam pattern adapted to produce a smaller focal spot on the anode, relative to the beam pattern of the emitter body 358A illustrated in FIGS. 9A and 9B. In various embodiments, the non-planar major surface 158 may be either concave or convex, as defined with respect to the electron beam direction (arrows), with the geometry being selected to focus or defocus the electron beam according to the desired focal spot size, density, and location.

FIGS. 11A and 11B provide a side sectional view and a plan view illustrating electron emission from a plurality of angled flat-surface emitter bodies 352C, for example in a multi-element LWF emitter 350C for an x-ray tube. As shown in FIGS. 11A and 11B, the major surfaces 358C of the emitter bodies 352C are distributed at different angles with respect to the electron beam direction (arrows), in a self-lensing or self-focusing orientation adapted for narrowing the electron beam to impinge on a smaller, denser focal spot.

Depending on the embodiment, the major surfaces 358A, 358B, 358C of each emitter body 352A, 352B, 352C may be planar or non-planar, and may be oriented either perpendicular to or at an angle relative to the beam direction. In non-planar embodiments, the major surface 358B of the emitter body 352B can be either concave or convex with respect to the adjacent (anode-facing) surface of the cathode head, or any of the major surfaces 358A, 358B, 358C may have a combination of convex and concave portions. A plurality of emitter bodies 352C can also be provided with differently shaped major surfaces 358C, or with major surfaces 358C disposed at different angles, or both.

FIG. 12 is a schematic section view of a LWF emitter 150 with a transmission anode target 850, in an embodiment with a shield 510 extending along one or more lateral side surfaces 159 of the emitter body. As shown in FIG. 12, electrons are emitted from the major surface 158 of the emitter body 152, and accelerated toward the anode target 850 by an electric potential applied across the anode-cathode spacing.

As compared to reflection targets, x-rays used in imaging from a transmission target 850 are those generated in substantially the same direction as the incident electron beam. X-rays are generated by the LWF emitter 150 in a full 360 degree distribution. However, emission from the side surfaces 159 is suppressed by the shield 510. Alternatively, a fixture, taper, undercut, or bevel could be used, as described above. In other embodiments, the emitter 150 is not limited to any particular form, and a transition anode 850 can be used with any suitable emitter design, encompassing any combination of the other embodiments and features disclosed herein. With the major surface emitting x-rays in a full 360 degree direction, the reflection target attenuates x-rays along the direction of the incident electron beam (greater than with a transmission target 850). That is, the proportion of x-rays traveling along the same direction as the incident electron beam after self-attenuation in the anode target 850 is much lower for the transmission target, than for the reflection target.

Figure 13A:
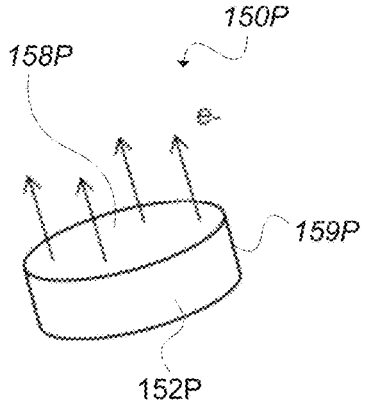
FIG. 13A is an isometric view illustrating electron emission from an oval or elliptical emitter body.
Figure 13B:
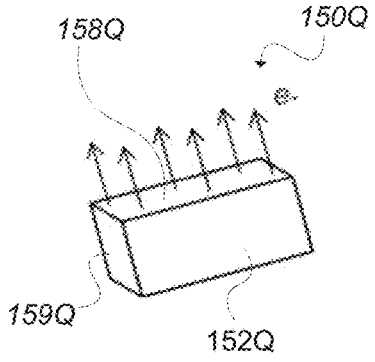
FIG. 13B is an isometric view illustrating electron emission from a rectangular emitter body.

FIG. 13A is an isometric view illustrating electron emission from an oval or elliptic emitter body 152P with side surfaces 159P (e.g., in a LWF emitter 150P for an x-ray tube). FIG. 13B is an isometric view illustrating electron emission from an emitter 150Q having a rectangular emitter body 152Q with side surfaces 159P, and FIG. 13C is an isometric view illustrating electron emission from an emitter 150R having an irregular or asymmetric emitter body 152R, with a plurality of lobes 860 and side surfaces 159R.

Figure 13C:
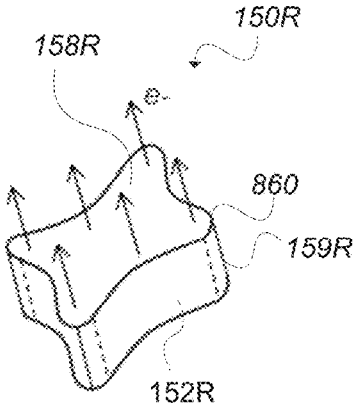
FIG. 13C is an isometric view illustrating electron emission from an irregular emitter body.

As shown in FIGS. 13A-13C, the emitter bodies 152P, 152Q, 152R may have major surfaces 158P, 158Q, and 158R with various regular, symmetric, and/or irregular geometries, adapted to provide sharp and even focal spots of selected sizes and shapes, with reduced off-focus x-ray production. The concavity, convexity, or flatness of each major surface 158P, 158Q, and 158R can also be adapted to modulate the emission density and electron beam direction, in order to determine the size, shape, and intensity of the focal spot.

In some embodiments, the major surface 158P, 158Q, and 158R of the emitter body 152P, 152Q, 152R is symmetric with respect to rotation of the emitter body within the cathode head. This prevents misalignment of the emitter with respect to the desired focal spot, as long as the base of the emitter is seated in the cathode head, regardless of angular orientation.

Alternatively, the major surface 158P, 158Q, and 158R of the emitter body 152P, 152Q, 152R may be asymmetric with respect to rotation of the emitter body 152P, 152Q, 152R within the cathode head. For example, the major surface 158P, 158Q, and 158R may be oblong or oblate, with an aspect ratio selected to modulate a size of the focal spot where the electron beam impinges on the anode.

The major surface 158P, 158Q, and 158R can also have one or more convex or concave lobes 860, which are adapted to modulate one or more of the size or the current density of the focal spot. In each of these configurations, complementary alignment pins, slots, or keys can be provided on the base of the emitter and on the seat in the cathode head, in order to correctly orient major surface 158P, 158Q, and 158R of the emitter body 152P, 152Q, 152R within the cathode assembly.

More generally, emitters 150P, 150Q, 150R of FIGS. 13A-13C are not otherwise limited to any particular form, encompassing any combination of the additional embodiments and features disclosed herein. For example, emitters 150P, 150Q, 150R can also be adapted to reduce emission from side surfaces 159, as compared to the major emitter surface 158P, 158Q, and 158R, for applications in rotating and fixed reflection anode systems, and in transmission target designs.

Figure 14:
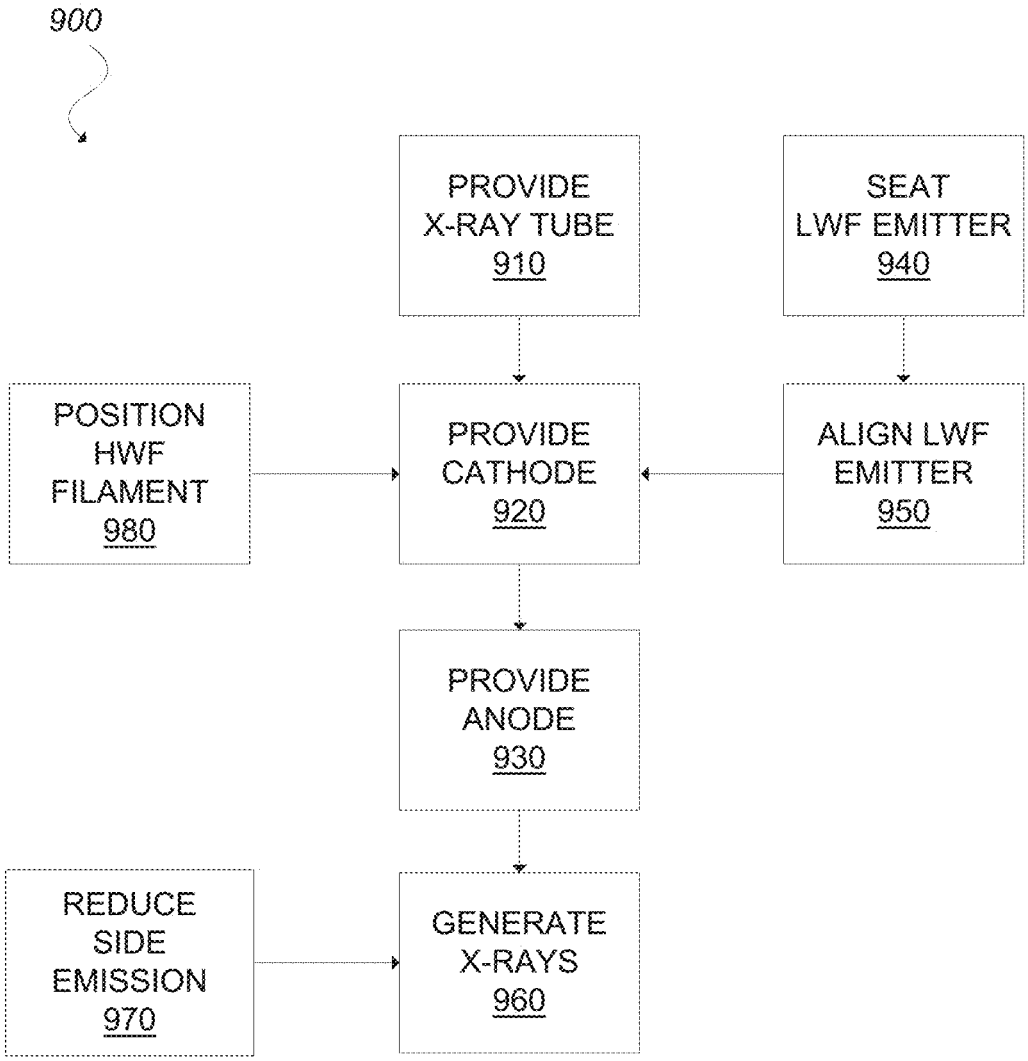
FIG. 14 is a block diagram illustrating a method for an x-ray tube system.

FIG. 14 is a block diagram illustrating a method 900 for assembling and operating an x-ray tube system, according to any of the embodiments described herein. As shown in FIG. 14, the method 900 includes one or more steps of providing an x-ray tube 100, 200, 300 (shown at 910) with a cathode 110, 210, 310, 400 (shown at 920) and an anode 120, 220, 320 (shown at 930). A low work function emitter 150, 150A-C, 150P-R, 250A-D, 350A-C can be seated in the cathode 110, 210, 310, 400 (shown at 940), and aligned with respect to the cathode head 140, 240, 440 (shown at 950), in order to generate x-rays (shown at 960).

In some examples, the emitter 150, 150A-C, 150P-R, 250A-D, 350A-C is adapted to reduce emission from secondary surfaces extending along the sides 159, 159A-D, 159P-R, 259, 359, of the emitter body 152, 152A-D, 152P-R, 252A-B, 352A-C (shown at 970). A high work function emitter 800 such as one including tungsten filaments can also be disposed in the cathode 110, 210, 310, 400, adjacent to the low work function emitter 150, 150A-C, 150P-R, 250A-D, 350A-C along the anode-facing surface 446 of the cathode head (shown at 980). A tungsten filament or similar high work function transition metal emission element may be used, for example, to provide a different focal spot size or profile, for use in a dual-focus x-ray tube 100, 200, 300. These acts can be executed in any order or combination, with or without additional processes and techniques adapted from other teachings in the specification, or as known in the art.

Seating the base 154 of the emitter 150, 150A-C, 150P-R, 250A-D, 350A-C in the cathode head 140, 240, 440 can include aligning the emitter body 152, 152A-D, 152P-R, 252A-B, 352A-C within an aperture 444 in the anode-facing surface 446 of the cathode head 140, 240, 440, so that the emitter body is disposed in a spaced relationship between the anode-facing surface 446 and a perimeter of the major surface 158, 158A-C, 158P-R, 258, 358A-C, and oriented toward the desired focal spot F on the anode 120, 220, 320. Manufacturing applications can also include additional assembly acts such as positioning the anode 120, 220, 320 and cathode 110, 210, 310, 400 in the vacuum enclosure 130, 230, 236, and closing the x-ray tube 100, 200, 300 to form a sealed insert 130, 230, after the vacuum enclosure 130, 230, 236 has been evacuated and treated to reduce operational outgassing. In operational applications, an end user may simply provide a suitably provisioned x-ray tube apparatus (e.g., x-ray tubes or assemblies 100, 200, 300, 400 or 500, as described herein), and operate the apparatus to generate x-rays.

In accordance with one embodiment of the disclosure, an emitter assembly 500 for a closed x-ray tube is provided. The emitter assembly comprises an emitter body 152 formed of a low work function material, the emitter body having a major surface 158 and a secondary surface 159. The major surface 158 is adapted for emission of electrons from the low work function material and the emitter assembly is adapted to reduce an emission current density emitted from the secondary surface 159 of the emitter body 152, as compared to the major surface 158.

The emitter assembly 500 can include a cathode head 140, wherein the emitter body 152 is disposed in a surface of the cathode head 140 to define a gap of less than 0.5 millimeter between the major surface 158 of the emitter body 152 and the surface of the cathode head 140, such that the emitter body 152 does not contact the surface of the cathode head 140.

In one embodiment, the low work function material comprises lanthanum hexaboride or cerium hexaboride.

In one embodiment, the low work function material comprises rhenium boride or cerium rhenium boride, a lanthanide crystal material, a rare earth metal boride, hafnium carbide or zirconium carbide, yttrium oxide, a tungsten thorium or tungsten lanthanum oxide, a tungsten zirconium oxide or other Schottkey emitter, or a dispenser cathode material.

The emitter assembly of claim 1, wherein the low work function material has a work function less than 4.0 electron volts (eV).

In one embodiment, the secondary surface 159 comprises a side surface extending from the major surface 158 of the emitter body 152, and further comprising a means for reducing an emission current density along the side surface as compared to the major surface 158.

In one embodiment, the means for reducing an emission current density along the side surface comprises a shield 510 on the side surface that includes a shield material having a work function higher than the low work function material on the side surface of the emitter body.

In one embodiment, the shield material comprises carbon, graphite, tungsten, rhenium, or platinum.

In one embodiment, the shield material is disposed on the emitter body 152 in direct contact with the side surface 159, with a thickness of less than one millimeter.

In one embodiment the emitter assembly further comprises a thermal decoupling between the shield 510 and the side surface 159 of the emitter body 152, wherein an outer surface of the shield operates at a lower temperature than the side surface of the emitter body.

In one embodiment the secondary surface 159 extends from the major surface 158 at an acute angle.

In one embodiment, the emitter assembly 500 further comprises a fixture 600 disposed about the emitter body 152, wherein the secondary surface 159 comprises a side surface extending from the major surface 158 along a side of the emitter body 152, and the fixture 600 is configured to modulate an electric field strength to reduce an emission current density along the side surface.

In one embodiment, the fixture 600 comprises a first fixture member 610 disposed in contact with the major surface 158 of the emitter body and a second fixture member 620 disposed in contact with the emitter body 152 at a location opposite the major surface, wherein the fixture members apply a mechanical bias to fix the emitter body 152 in place therebetween.

In accordance with another embodiment of the disclosure, a cathode assembly 110 for a closed x-ray tube is provided. The cathode assembly comprises a cathode head 140 and an emitter 150 disposed in the cathode head. The emitter comprises an emitter body 152 coupled to a base 154 and having a major surface 158 adapted for emission of electrons, wherein the emitter body 152 is formed of a low work function material. The assembly further includes means 510, 520, 530, 600 for reducing an emission current density emitted from a side surface of the emitter body, as compared to the major surface.

In one embodiment, a gap defines a distance between the emitter body and the cathode head of the cathode assembly. The distance can be less than 0.5 millimeter (mm).

In one embodiment, the low work function material of the emitter body 152 has a work function less than 4.0 electron volts (eV).

In one embodiment, the further comprising a second emitter element 810 disposed adjacent the emitter body 152 along an anode-facing surface of the cathode head, wherein the second emitter element is formed of a transition metal.

In one embodiment, the second emitter element 810 comprises a tungsten filament.

In one embodiment, the emitter of the cathode assembly is rotationally symmetric about an axis and an opening in the cathode head is rotationally symmetric about the axis.

In one embodiment, the axis extends perpendicularly to the major surface of the emitter body.

In one embodiment, the major surface of the emitter is a non-planar surface.

In one embodiment, a closed x-ray tube includes a cathode assembly, and further comprises an anode adapted to emit x-rays responsive to impingement of the electrons emitted from the major surface of the emitter, wherein the anode is configured as a transmissive target or a reflective target.

In one embodiment, the emitter body 152 is disposed in a fixture 600 that defines a mask or emission window 650 having a top surface 615, wherein the major surface 258 of the emitter body 152 is in plane with the top surface 615 of the mask.

In one embodiment, the emitter body 152 is disposed in a fixture 600 that defines a mask or emission window 650 having a top surface 615, wherein the major surface 258 of the emitter body 152 is recessed relative to the top surface 615 of the mask.

In one embodiment, the fixture 600 is fixed to the emitter body 152 via mechanical means.

In one embodiment, the mask or emission window 650 defined by the fixture 600 can have a circular shape, a rectangular shape, a non-symmetric shape, any linear or non-linear shape, or combinations thereof.

In accordance with another embodiment of the present disclosure, a method is provided which comprises providing an x-ray tube and providing a cathode 110 in the x-ray tube. The cathode having an emitter 150 seated in the cathode head 140, the emitter 150 comprising an emitter body 152 formed of a low work function material having a major surface 158 adapted for emitting electrons, and providing an anode in the x-ray tube. According to this embodiment, the anode and the cathode are sealed within the x-ray tube.

In one embodiment, the low work function material comprises a cerium boride, lanthanum boride, rhenium boride or cerium rhenium boride, hafnium carbide or zirconium carbide, yttria, thoriated tungsten, or tungsten-lanthanum oxide, a Schottkey emitter, or a dispenser cathode material.

In one embodiment, the method further comprises seating a base 154 of the emitter 150 in the cathode head 140 and aligning the emitter body 152 within an aperture 444 in an anode-facing surface of the cathode head 140, and spacing the emitter body from a perimeter of the aperture 444.

In one embodiment, the method further comprises disposing a second emitter element 810 within an anode-facing surface of the cathode head, wherein the second emitter element comprises a metal filament.

In one embodiment, the emitter 150 is seated in the cathode head 140 with the emitter body 152 being rotationally symmetric about an axis of the x-ray tube.

In one embodiment, aligning the emitter body within the aperture comprises aligning the major surface perpendicular to an axis of the x-ray tube.

In one embodiment, the major surface of the emitter body is a non-planar or concave surface.

In one embodiment, providing the anode in the x-ray tube further comprises providing the anode in a stationary position with respect to the cathode, or providing the anode in a rotating configuration with respect to the cathode.

In one embodiment, providing the anode in the x-ray tube further comprises providing a reflective target for the electrons emitted from the major surface of the emitter, or providing a transmissive target for the electrons emitted from the major surface of the emitter.

In one embodiment, the method further comprises providing a shield, fixture, or bevel along a side surface of the emitter body, and reducing an emission current density of the side surface of the emitter body with respect to the major surface, responsive to the shield, fixture, or bevel.

In one embodiment, the method comprises providing the cathode, including engaging the emitter with an alignment feature in the cathode head, wherein the major surface of the emitter body is aligned with respect to the anode for operation of the x-ray tube, responsive to engaging the emitter with the alignment feature.

While these systems and methods have been described with reference to exemplary embodiments, it will be understood by those skilled in the art that various changes may be made and equivalents can be substituted to adapt these teachings to other problems, materials, and technologies, without departing from the scope of the claims. Features, aspects, components or acts of one embodiment may be combined with features, aspects, components, or acts of other embodiments described herein. The invention is thus not limited to the particular examples that are disclosed, but encompasses all embodiments falling within the appended claims.

What is claimed is:

1. An emitter assembly for a closed x-ray tube, comprising:

an emitter body formed of a low work function material, the emitter body having a major surface and a secondary surface;

wherein the major surface is adapted for emission of electrons in a direction from the low work function material and wherein the emitter assembly is adapted to reduce an emission current density emitted from the secondary surface of the emitter body, as compared to the major surface, wherein the secondary surface extends laterally from the major surface opposite from the direction of the emission of electrons.

2. The emitter assembly of claim 1, further comprising a cathode head; wherein the emitter body is disposed in a surface of the cathode head to define a gap of less than 0.5 millimeter between the major surface of the emitter body and the surface of the cathode head, such that the emitter body does not contact the surface of the cathode head.

3. The emitter assembly of claim 1, wherein the low work function material comprises lanthanum hexaboride or cerium hexaboride.

4. The emitter assembly of claim 1, wherein the low work function material comprises rhenium boride or cerium rhenium boride, a lanthanide crystal material, a rare earth metal boride, hafnium carbide or zirconium carbide, yttrium oxide, a tungsten thorium or tungsten lanthanum oxide, a tungsten zirconium oxide or other Schottkey emitter, or a dispenser cathode material.

5. The emitter assembly of claim 1, wherein the low work function material has a work function less than 4.0 electron volts (eV).

6. The emitter assembly of claim 5, further comprising a thermal decoupling between the shield and the side surface of the emitter body, wherein an outer surface of the shield operates at a lower temperature than the side surface of the emitter body.

7. The emitter assembly of claim 1, wherein the secondary surface comprises a side surface extending from the major surface of the emitter body and means for reducing an emission current density along the side surface as compared to the major surface.

8. The emitter assembly of claim 7, wherein means for reducing an emission current density along the side surface comprises a shield on the side surface that includes a shield material having a work function higher than the low work function material on the side surface of the emitter body.

9. The emitter assembly of claim 7, wherein the shield material comprises carbon, graphite, tungsten, rhenium, or platinum.

10. The emitter assembly of claim 7, wherein the shield material is disposed on the emitter body in direct contact with the side surface, with a thickness of less than one millimeter.

11. The emitter assembly of claim 1, wherein the secondary surface extends from the major surface at an acute angle.

12. The emitter assembly of claim 1, further comprising a fixture disposed about the emitter body, wherein the secondary surface comprises a side surface extending from the major surface along a side of the emitter body, and the fixture is configured to modulate an electric field strength to reduce an emission current density along the side surface.

13. The emitter assembly of claim 1, wherein the low work function material is configured to emit electrons at a temperature below 1500° C.

14. A cathode assembly for a closed x-ray tube, comprising:

a cathode head;

an emitter at least partially disposed in the cathode head, the emitter comprising an emitter body coupled to a base and having a major surface adapted for emission of electrons, wherein the emitter body is formed of a low work function material; and means for reducing an emission current density emitted from a side surface of the emitter body, as compared to the major surface, wherein the side surface extends laterally from the major surface away from an anode.

15. The cathode assembly of claim 14, wherein a gap defines a distance between the emitter body and the cathode head and the distance is less than 0.5 millimeter (mm).

16. The cathode assembly of claim 14, wherein the low work function material has a work function less than 4.0 electron volts (eV).

17. The cathode assembly of claim 14, further comprising a second emitter element disposed adjacent the emitter body along an anode-facing surface of the cathode head, wherein the second emitter element is formed of a transition metal.

18. The cathode assembly of claim 17, wherein the second emitter element comprises a tungsten filament.

19. The cathode assembly of claim 14, wherein the emitter is rotationally symmetric about an axis and an opening in the cathode head is rotationally symmetric about the axis.

20. The cathode assembly of claim 19, wherein the axis extends perpendicularly to the major surface of the emitter body.

21. The cathode assembly of claim 14, wherein the major surface of the emitter is a non-planar surface.

22. A closed x-ray tube comprising the cathode assembly of claim 14, and further comprising an anode adapted to emit x-rays responsive to impingement of the electrons emitted from the major surface of the emitter, wherein the anode is configured as a transmissive target or a reflective target.

23. A method comprising:

providing an x-ray tube;

providing a cathode in the x-ray tube including:

seating a base of an emitter in a cathode head, the emitter comprising an emitter body formed of a low work function material having a major surface adapted for emitting electrons; and spacing the emitter body from a perimeter of an aperture in an anode-facing surface of the cathode head;

providing an anode in the x-ray tube;

wherein the anode and cathode are sealed within the x-ray tube.

24. The method of claim 23, wherein providing the cathode further comprises:

aligning the emitter body within the aperture in an anode-facing surface of the cathode head.

25. The method of claim 23, wherein providing the cathode further comprises:

engaging the emitter with an alignment feature in the cathode head;

wherein the major surface of the emitter body is aligned with respect to the anode for operation of the x-ray tube, responsive to engaging the emitter with the alignment feature.

* * * * *